US009453338B1

(12) United States Patent
Gobeil

(10) Patent No.: US 9,453,338 B1
(45) Date of Patent: Sep. 27, 2016

(54) ROLLABLE GUTTER FOR DECK STRUCTURE

(71) Applicant: Eric Gobeil, St-Augustin (CA)

(72) Inventor: Eric Gobeil, St-Augustin (CA)

( * ) Notice: Subject to any disclaimer, the term of this patent is extended or adjusted under 35 U.S.C. 154(b) by 0 days.

(21) Appl. No.: 14/255,564

(22) Filed: Apr. 17, 2014

(51) Int. Cl.

| | |
|---|---|
| ***E04B 1/70*** | (2006.01) |
| ***E04B 5/48*** | (2006.01) |
| ***E04B 1/64*** | (2006.01) |
| ***E04B 1/66*** | (2006.01) |

(52) U.S. Cl.
CPC . *E04B 5/48* (2013.01); *E04B 1/64* (2013.01); *E04B 1/66* (2013.01)

(58) Field of Classification Search
USPC ..... 52/302.1, 302.3, 302.6, 302.7, 478
See application file for complete search history.

(56) References Cited

U.S. PATENT DOCUMENTS

| | | | | |
|---|---|---|---|---|
| 4,860,502 | A * | 8/1989 | Mickelsen et al. | 52/11 |
| 6,244,007 | B1 * | 6/2001 | Heikkila | 52/302.3 |
| 6,796,092 | B1 * | 9/2004 | Goebel | 52/302.1 |
| 6,886,302 | B2 * | 5/2005 | Jackson | 52/302.3 |
| 2005/0072081 | A1 * | 4/2005 | Goebel | 52/302.1 |

* cited by examiner

*Primary Examiner* — Basil Katcheves

(57) ABSTRACT

In a balcony comprising parallel transverse boards forming a floor, transverse joists and longitudinal parallel joists supporting the transverse boards, the installation of a water-tight underdeck membrane above each pair of longitudinal joists protects the structure from decomposing by recuperating water infiltrating between boards. The membrane comprises flat sloped zones and a foldable gutter shaped zone between two flat zones. The gutter zone becomes progressively deeper from upstream till downstream by stretching it with fingers. At the most upstream point of the balcony, above the first transverse joist attached against a wall of a construction, the gutter zone is completely flattened to bend the membrane and put it against the wall, thus acting as a flashing which collects water flowing along the wall before infiltrating into joists. The membrane is rollable for facilitating transportation and also to cut at a desired length according to balcony length for avoiding unnecessary junction.

14 Claims, 5 Drawing Sheets

20
22
22'
24
25
25'
26
27
28
29
30
30'
32
23
44
48
48'
50
W
W'

ROLLABLE GUTTER FOR DECK STRUCTURE

BACKGROUND

1. Field of the Invention

This invention belongs to the field of construction, particularly to the field of gutter membranes used between or under the joists of a balcony to evacuate water infiltrating between boards. The gutter membrane protects the structure from water causing the decomposition of such structure. The gutter membrane also creates a dry space under the deck for extra storage.

2. Description of the Prior-Art

A previous provisional application U.S. 61/813,381 "Rollable gutter for deck structure" for the same invention was filed on Apr. 18, 2013 by same author. Some patents of the Prior Art have caught our attention:

U.S. Pat. No. 6,212,837 filed on Aug. 3, 2009 by R. A. Davis and L. A. Prohofsky, discloses a rain water diverter system for the underside of deck joists, comprising a collector 32 fixed between deck joists 10. On the ends of the collector are fixed gutters 36 which are positioned inside each deck. Water slides along the collector, which is bent as a dune, and flows inside gutters which bring water out of the construction.

U.S. Pat. No. 6,415,571 filed on Apr. 13, 2001 by K. B. Risser, shows panels 300,320 placed between joists 20,22, 24. Each panel is placed between two joists; the panel 300 is placed between joists 20,22; the panel 320 is placed between joists 22,24. The panels overlap the joists and they are placed such that they are forming a curve in the space between two joists. They then permit the necessary fall to assure that water passing through deck boards 27,28 is collected along the panels and flows outside the construction.

OBJECTIVES AND ADVANTAGES

There is a need on the market of construction for membranes which are used to evacuate away from a balcony water flowing between boards, to avoid structure decomposition and to create a dry space under the deck. The Prior Art shows somes membranes positioned above or under the joists, but none of the Prior Art shows a membrane which receives, at the same time, the water infiltrating between the boards of a balcony and the water which infiltrates upstream in the space between the wall of the construction and the covering of the wall (such as a tight/dryness membrane covering the wall), the water thereof sinks along the tight membrane then it is received by our membrane, then diverts outside the balcony. None of the prior art membrane can thus in a same piece, covering the upstream transverse joist then make a gutter between each longitudinal joist and finally raise to cover the downstream transverse joist. And furthermore our membrane is rollable (a roller of 100 foot long for example) to permit to cut at a desired length for having the right dimensions, thus avoiding transversal junction.

The membrane of our invention is installed above a pair of longitudinal joists, and forms a type of gutter. Such gutter membrane comprises three zones, a flat zone followed by a foldable gutter zone followed by another flat zone. Each flat zone being fixed above one of the joists of the pair. The flat zone is then sloped thus creating a necessary space between the membrane and the boards to allow a better flow of the water along the sloped zone towards the center where is located the gutter zone which drains water downstream and discharge out of the balcony.

When the foldable gutter zone is flattened, the membrane is at a "closed position" (see FIG. 1). The gutter zone could be unfolded or stretched, this configuration is named "opened position" (see FIG. 2). At an "open position" the width of the membrane is larger than in the closed position because of the stretching of the gutter zone.

During installation above the pair of joists the gutter zone is progressively opened/deeper creating gutter depression (see FIG. 3) to drive water away from the balcony.

In the closed position the membrane is rollable to facilitate transportation. Before utilization, the membrane is unrolled and cut at a desired length for avoiding any transversal junction of additional membranes.

Another advantage of the closed position is that the membrane may be inserted under the dryness membrane of the wall of the house to collect the water infiltrating between the dryness membrane and a covering for the wall (bricks, wood, etc. . . . placed outside the wall).

INSTALLATION

The membrane arrives rolled with a sufficient width for installation between two parallel joists.

- The membrane is first cut at the desired length comprising length of the balcony plus the length of the flushing against the wall plus 3 inches to compensate for the extra length needed for the gutter depression.
- The membrane is unrolled, the foldable gutter zone is flattened, and the membrane is first inserted upstream, under the dryness membrane against the wall of the house, to collect the water infiltrating between the dryness membrane and the covering for the wall (see FIG. 4A and FIG. 4B). After this first insertion, the membrane is then fixed upstream above the joist laid against the wall of a house.
- The membrane is then fastened above two parallel longitudinal joists with the foldable gutter zone between the joists, and then the gutter zone is progressively opened from upstream till downstream by means of fingers; thus forming a gutter depression (sec FIG. 3).
- Completely downstream the balcony, where is the last transverse board ending the balcony, the membrane could be raised above this last transverse joust and flattened for covering it (see FIG. 6), and then the membrane is cut and fastened. A hole is made in the membrane at the lowest downstream point of the gutter zone to evacuate water outside the balcony (see FIG. 5).

In the closed position the width of the membrane is equal to the width between a pair of parallel joists (at the exterior sides of two joists), but in the opened position the width of the membrane is becoming progressively larger thus creating the gutter depression.

When the distance between two parallel joists is less than 16 inches center to center (standard dimensions), the membrane is cut at the desired width. If the width between two parallel joists is larger than 16 inches, the membrane could be made larger (at the manufacture).

The present invention will be further understood from the following description with reference to the drawings wherein like numbers refer to like parts for easy identification.

BRIEF DESCRIPTION OF DRAWING FIGURES

DETAILED DESCRIPTION OF THE PREFERRED EMBODIMENTS

Figures 1, 2, 3:
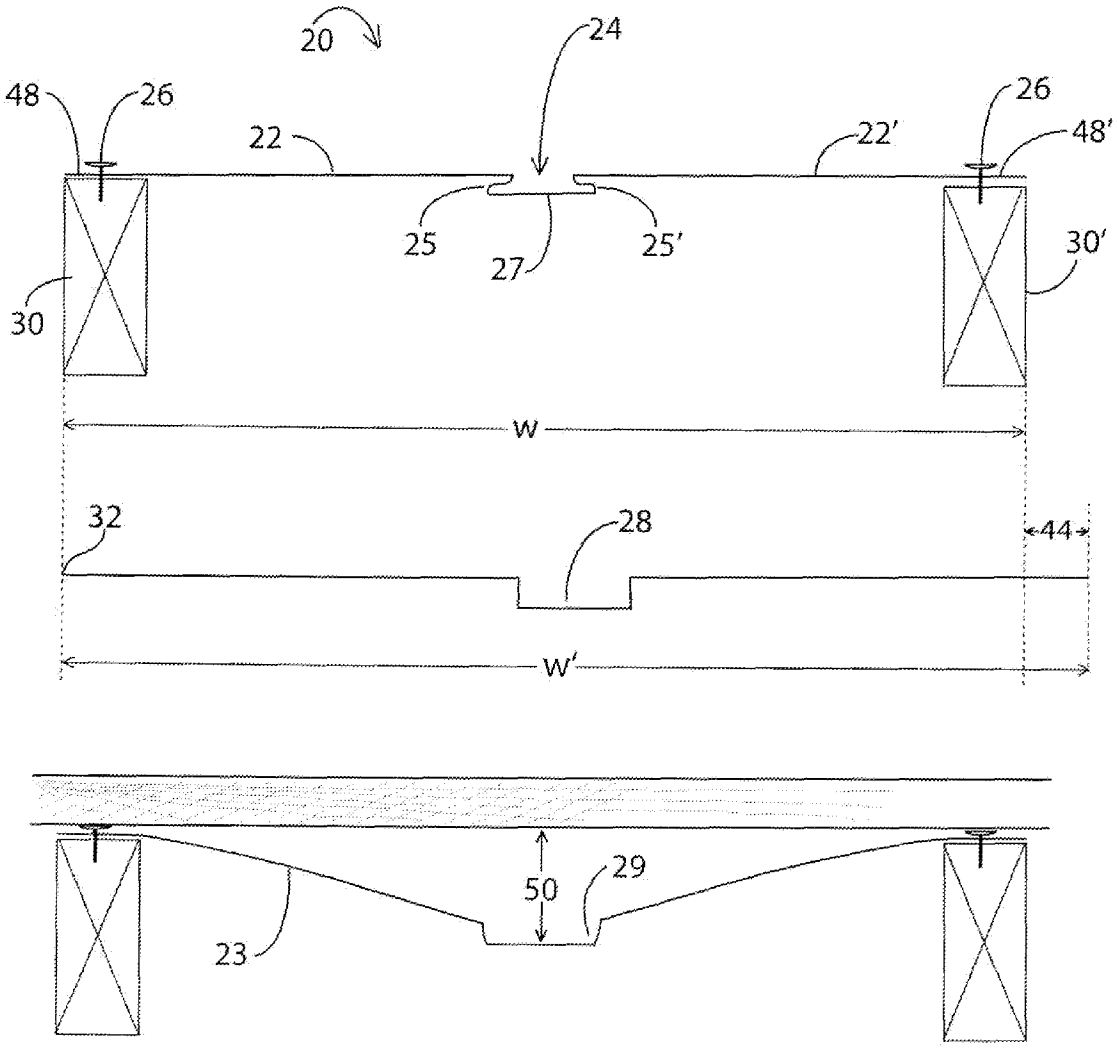
FIG. 1 is a front view of the membrane with the foldable gutter zone closed.
FIG. 2 is a front view of the membrane with the foldable gutter zone stretched.
FIG. 3 is a front view of the membrane installed between two parallel joists.

FIG. 1 shows a watertight underdeck membrane 20 in a closed position having a cover 48 zone over first 30 joist followed by a flat zone 22 followed by a foldable gutter zone 24 followed by another flat zone 22' followed by another cover zone 48' over second 30' joist.

The gutter zone comprises a z-fold 25 followed by a flat bottom part 27 and followed by a reversed z-fold 25'.

Means of fixation 26,26' are used to attach the membrane above joists. Recommanded dimensions for standard decks are: for each z-bands ½ inch spaced by 1 inch. The width <<w>> of the folded membrane is 17.5 inches between the joists 30,30' (16 inches center to center).

FIG. 2 shows the watertight underdeck membrane in an opened position with the gutter zone more stretched and having a rectangular shape 28, thus making the membrane one (1) inch larger <<w'>> than in FIG. 1. This one (1) inch larger corresponds to the space 44 after the expansion resulting coming from z-folds 25-25' opening or stretching.

FIG. 3 shows the opened membrane installed above two parallel joists with the flat zone having a slope 23 and the gutter zone 29 which goes down to create the gutter depression 50.

Figure 4A:
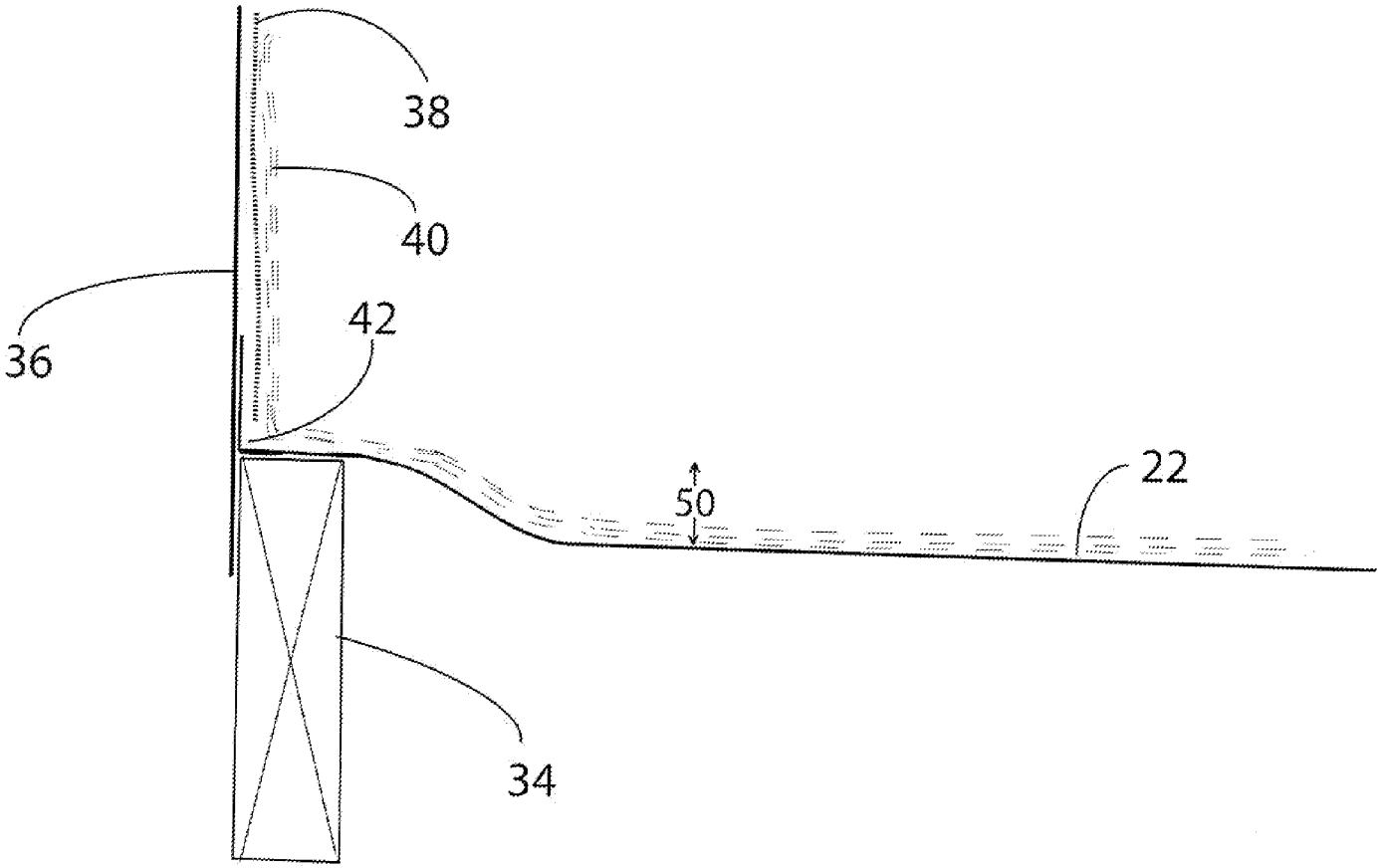
FIG. 4A is a transversal view at a junction of the wall and the balcony.

FIG. 4A shows a transversal view of a wall 36 of a house or a construction against which a transverse joist 34 is positioned; the membrane 22 could be bent 42 90° above the joist 34 to be inserted at the junction of the wall and a dryness membrane 38 often used to cover the wall. The membrane being inserted under the dryness membrane to collect the water infiltrating between the dryness membrane and a covering for the wall (not shown here, the covering could be bricks, wood, . . . placed outside the wall). At this junction the membrane must be in a closed position to permit the 90° fold against the wall. On top of the tranverse joist the membrane is in closed position then the membrane is progressively opened and sunk between parallel joists to create the gutter depression 50.

Figure 4B:
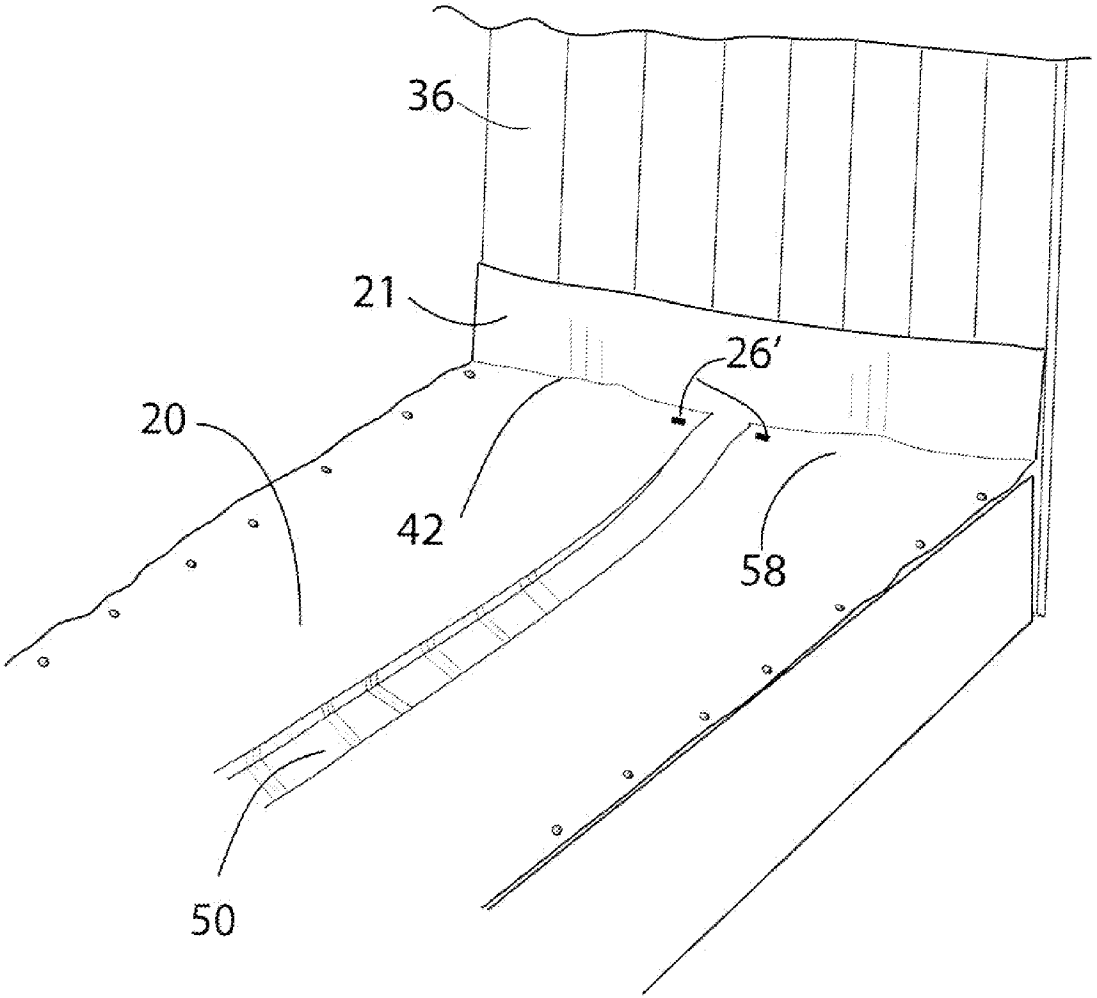
FIG. 4B is a perspective view at a junction of the wall and the balcony.

FIG. 4B shows the membrane 20 bent 42 at the angle 90° along the wall 36 of the house. At the junction with the wall of the house the membrane is flattened and fixed 26', thus corresponding to a closed position 58 which facilitates its folding along the wall. Then the membrane is progressively opened and sunk between parallel joists to create the gutter depression 50.

Figure 5:
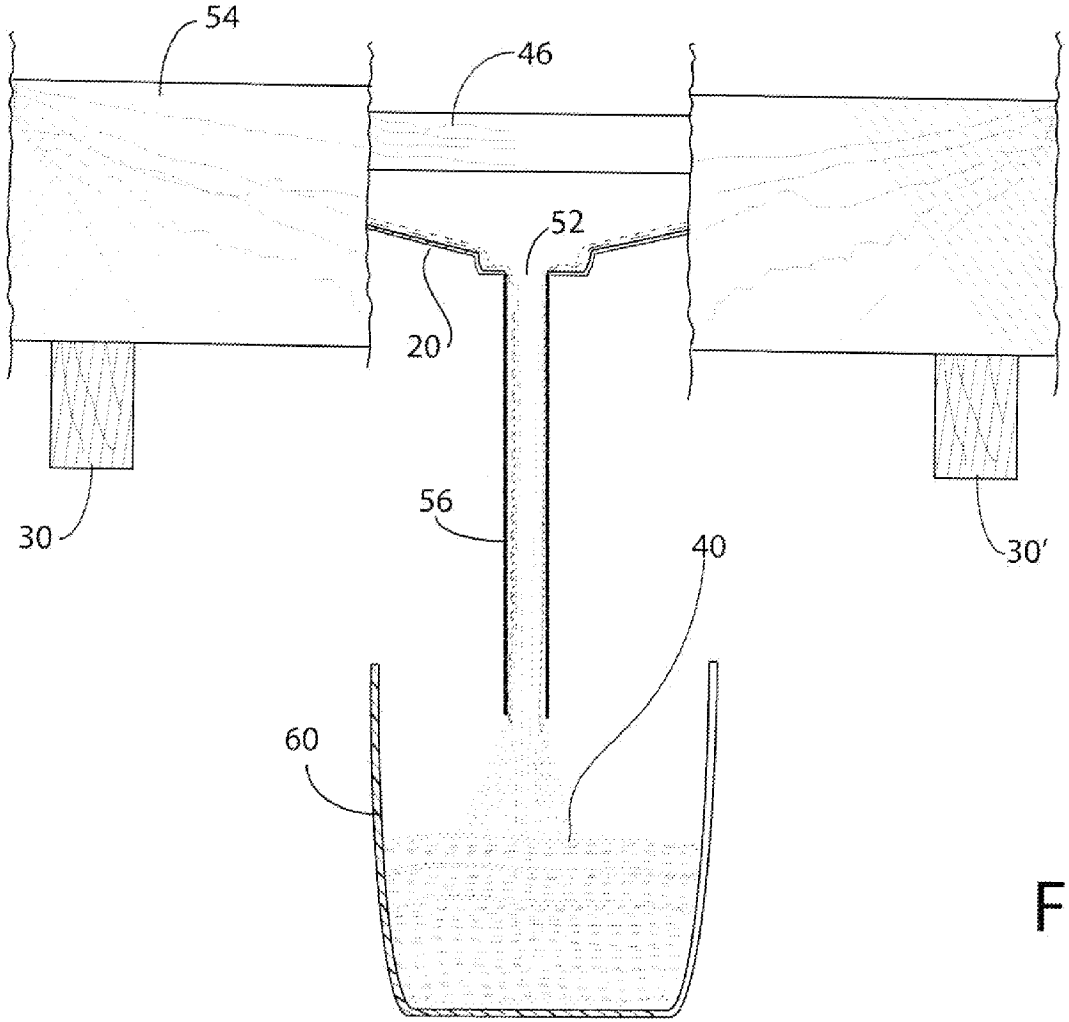
FIG. 5 is a cut view of the membrane downstream the balcony.

FIG. 5 shows the membrane 20, precisely downstream the balcony, having a hole 52 acting as a funnel for evacuating water. The water is then got back in a barrel 60. Means of pipe 56 are fixed under the hole to drain water towards the barrel.

Figure 6:
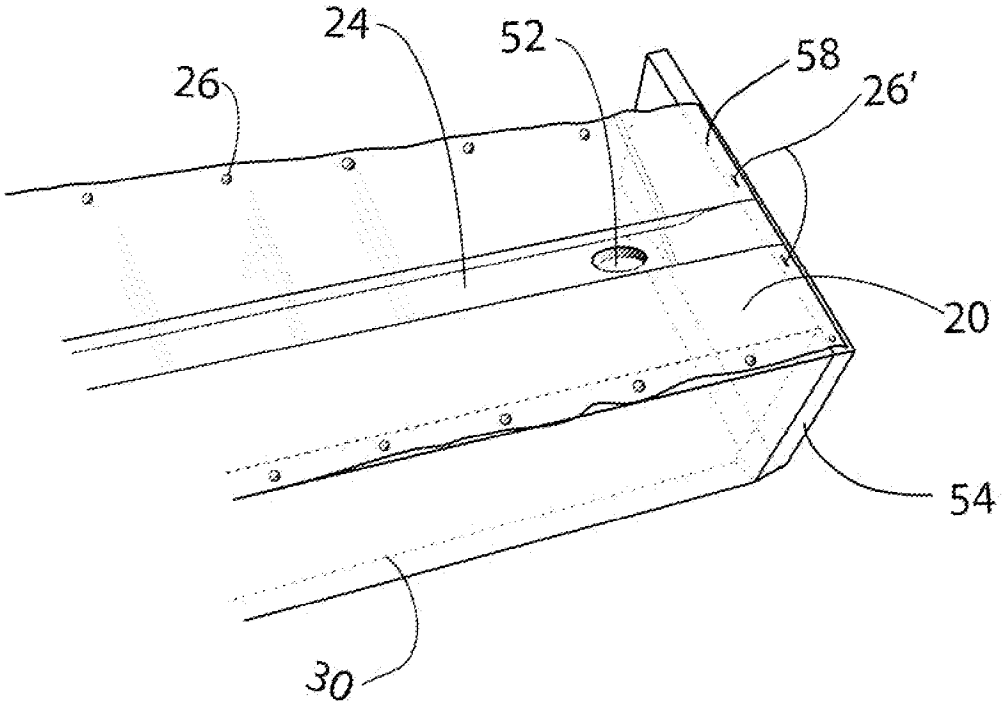
FIG. 6 is a perpective view showing a downstream evacuation hole.

FIG. 6 shows the membrane 20 installed 26 above a pair of joists 30-30' and above a last transverse downstream joist 54 having a hole 52 dug on the gutter 24 zone downstream the balcony; the hole acts as funnel where passes water, which can be recuperate under the balcony in a barrel. Above the last transverse joist the membrane is flattened and fixed 26' in the closed position 58.

SUMMARY

In a balcony comprising parallel transverse boards 46 forming the floor supported by longitudinal parallel joists 30 and transverse joists 34 and 54, the introduction of a watertight underdeck membrane 20 fixed by means of fixation 26,26' above two parallel joists allowing to collect water passing between the boards and discharging downstream to protect the structure from decomposition. Such watertight membrane 20 comprises a cover zone 48 over first 30 joist followed by a flat zone 22 followed by a foldable gutter zone 24 followed by another flat zone followed by another cover zone 48' over the second 30' joist. A supplemental dryness membrane is placed over the cover junction zone, to protect water infiltration between membrane overlappings.

The foldable gutter zone 24 comprises a z-fold 25 followed by a flat bottom part 27 and followed by a reversed z-fold 25', the foldable gutter zone being progressively opened deeper from upstream till downstream by stretching out the z-folds 25,25'.

The z-folds being completely flattened at the most upstream of the balcony, precisely above the upstream transverse joist 34 laid against the wall 36 of the construction, thus allowing to bend the membrane against the wall and collect water flowing along the wall before infiltrating the first joist.

The flat zone 22 being sloped 23 to create an open space called the gutter depression 50 (see FIG. 3) between the boards and the membrane to evacuate water towards the gutter zone for draining and discharging downstream.

The z-folds 25,25' are progressively stretched until the gutter zone is rectangular-shaped 28 (see FIG. 2). In opened position the membrane being larger than a distance between two joists, which creates the gutter depression (see FIG. 3) in which water will run out the deck without membrane folding or wrinkles on top of the joist at the fixation points.

Recommanded dimensions for standard deck are: for each z-fold ½ inch spaced 44 by 1 inch. The width of the membrane is 17.5 inches between the joists 30,30' of 2"×10" inches (16 inches center to center).

The membrane can be made of only one z-fold 25 following the flat sloped zone 22; a gutter depression 50' is created by stretching the fold with fingers.

When a dryness 38 membrane is used to cover the wall of the house, the watertight membrane 20 is bent upstream and inserted into a space between the wall and the dryness membrane for collecting water infiltrating and flowing along the dryness membrane.

In the watertight membrane a hole acting as a funnel 52 (see FIG. 6) is dug downstream to bring out water and collect it under the balcony in means of barrel 60 (see FIG. 5). To pierce directly the membrane allows avoiding the purchase of a funnel downspout equipment installed at the end of the membrane, and thus reducing the costs of installation.

Downstream the balcony, the last downstream transverse joist 54 is ending the balcony; the membrane can be raised above the last joist 54 and completely flattened for covering this last transverse joist 54.

Our membrane is sold in a roller shape disposition at a factory made possible by completely flattening the foldable gutter zone, thus facilitating transportation.

The membrane is of course slightly tilted because it is common that the balcony be slightly tilted from the house to the outside. In effect the longitudinal parallel joists are generally installed with a slope (from upstream to downstream) of 1/14" per foot thus facilitating even more the flow of water.

It is to be clearly understood that the instant description with reference to the annexed drawing is made in an indicative manner and that the preferred embodiments described herein are meant in no way to limit further embodiments realizable within the scope of the invention.

PARTS

20 Watertight underdeck
20,22' Flat zones
23 Sloped flat zone
24 Foldable gutter zone
25-25' Z-fold, reversed-Z fold
26-26' Means of fixation
28 Stretched gutter zone in a rectangular-shaped zone
29 Further stretched gutter zone
30-30' Longitudinal joists
32 An end of the underdeck
34 Joist laid against the wall of a house (upstream transverse joist)
36 Wall of a house
38 Waterproof tight/dryness membrane for the wall 36
40 Water infiltrating between the wall and the tight membrane 38
42 Straight angle (90°)
44 Expansion resulting from z-folds 25-25' opening or stretching'
46 Transverse joist
48-48' Cover zones
50 Gutter depression
50' Gutter depression formed with one z-fold
52 Funnel
54 Last downstream transverse joist
56 Means of pipe
58 Closed position
60 Barrel

I claim:

1. In a balcony comprising parallel transverse boards (46) forming a floor of said balcony supported by longitudinal parallel joists (30,30') and by transverse joists (34,54), said balcony having a very first transverse joist (34) located upstream and laid against a wall of a construction; the introduction of a watertight underdeck membrane (20) fixed above two of said parallel joists allowing to collect water passing between said boards and discharging downstream, said membrane comprising:

a cover zone (48) over a first (30) of said joist followed by a flat zone (22) followed by a foldable gutter zone (24) followed by a second flat zone (22') followed by a second cover zone (48') over a second (30') of said joist, said foldable gutter zone comprising a z-fold (25) followed by a flat bottom part (27) and followed by a reversed z-fold (25'), said gutter zone being progressively opened and deeper from upstream till downstream by stretching out said z-folds (25,25') to create a gutter depression (50); said z-folds being completely flattened at the most upstream of said balcony, precisely above said upstream transverse joist (34), thus allowing to bend said membrane against said wall and collect water flowing along said wall before infiltrating said very first joist:

said flat zone (22) being sloped (23) thus creating an open space gutter depression (50) between said parallel transverse boards and said membrane to evacuate said water into said foldable gutter zone for draining and discharging water downstream:

once in opened position, said membrane being larger than a distance between said two parallel joists, thus allowing to deepen said gutter zone thus creating a gutter depression without warping said membrane at its junctions with said two joists.

2. The membrane of claim 1 wherein a dryness membrane is covering said wall and said membrane is bent upstream and inserted into a space between said wall and said dryness membrane, for collecting water infiltrating and flowing along said dryness membrane.

3. The membrane of claim 1 wherein said z-fold and reversed z-fold are ½ inch in width and separated from each other by 1 inch.

4. The membrane of claim 1 wherein said z-fold and reversed z-fold are progressively opened until said gutter zone is rectangular-shaped (28).

5. The membrane of claim 4 wherein said z folds being further stretched under gravity, hand pressure during installation, or the weight of said water, to create a gutter depression (50).

6. The membrane of claim 1 wherein said fixations are screws (26,26').

7. The membrane of claim 1 in a flattened, rolled disposition for facilitating transportation.

8. The membrane of claim 1 wherein a supplemental dryness membrane is placed to cover the junction between each said membrane on top of each parallel joist over said cover zone, where membranes overlap, to protect from water and decomposition.

9. The membrane of claim 1 wherein a hole (52) is dug downstream on said membrane to bring out water and collect it under said balcony in means of barrel (60).

10. The membrane of claim 1 wherein a last downstream transverse joist (54) is ending said balcony, said membrane is progressively closed and flattened then raised above said last downstream transverse joist and to cover said last transversal joist.

11. In a balcony of a construction, said balcony comprising parallel boards (46) supported by longitudinal parallel joists (30,30') and by transverse joists (34, 54), a first transverse joist (34) being located upstream and laid against a wall of said construction; the introduction of a watertight underdeck membrane (20) fixed above two of said parallel joists allowing to collect water passing between said boards and discharging downstream, said membrane comprising:

a cover zone (48) over a first (30) of said joists followed by a first flat zone (22) followed by a foldable gutter zone (24) followed by a second flat zone (22') followed by a second cover zone (48') over a second (30') of said joists, said foldable gutter zone comprising a z-fold (25) followed by a flat bottom part (27), said gutter zone being progressively opened and deeper from upstream till downstream by stretching out said z-fold (25) to create a gutter depression (50'); said z-fold being completely flattened at the most upstream of said balcony, above said upstream transverse joist (34), thus allowing to bend said membrane against said wall and collecting water flowing along said wall;

said first flat zone (22) being sloped (23) thus creating an open space gutter depression (50) between said parallel transverse boards and said membrane to evacuate said water into said foldable gutter zone for draining and discharging water downstream;

once in opened position, said membrane being larger than a distance between said two parallel joists, thus allowing to deepen said gutter zone which creates a gutter depression without warping said membrane at its junctions with said two joists.

12. The watertight membrane of claim 11 destined to create a dry space under said boards for extra storage.

13. The membrane of claim 11 covering said two joists (30,30') downstream and upstream thereby facilitating installation of said membrane without using additional membranes.

14. The membrane of claim 11 wherein a hole (52) is downstream on said membrane to bring water to a water collection device, said hole acting as a funnel.

* * * * *